US006568405B2

(12) United States Patent
Masuyama

(10) Patent No.: US 6,568,405 B2
(45) Date of Patent: May 27, 2003

(54) CONTAINER FOR LIQUIDS

(75) Inventor: Iwao Masuyama, Fuchu (JP)

(73) Assignee: Tokyo Parts Co., Ltd., Tokyo (JP)

( * ) Notice: Subject to any disclaimer, the term of this patent is extended or adjusted under 35 U.S.C. 154(b) by 0 days.

(21) Appl. No.: 09/906,462

(22) Filed: Jul. 16, 2001

(65) Prior Publication Data

US 2002/0014252 A1 Feb. 7, 2002

(30) Foreign Application Priority Data

Aug. 3, 2000 (JP) ..... 2000-235305
Jun. 28, 2001 (JP) ..... 2001-196332

(51) Int. Cl.[7] ..... A45D 40/26; A45D 40/24; A46B 17/08; A46B 11/00

(52) U.S. Cl. ..... 132/218; 132/317; 401/122; 401/126

(58) Field of Search ..... 132/218, 317, 132/320, 318; 401/4, 122, 123, 126, 127, 128, 129

(56) References Cited

U.S. PATENT DOCUMENTS 3,204,283 A * 9/1965 Damron ..... 401/4
3,311,941 A * 4/1967 Buchwalter et al. ..... 401/4
3,456,923 A 7/1969 Zeuzem ..... 259/108
4,290,706 A * 9/1981 Wandl ..... 401/4
4,984,918 A * 1/1991 Iizuka et al. ..... 401/4
5,172,992 A * 12/1992 Ackermann ..... 401/4
5,700,100 A 12/1997 Ackermann ..... 401/4
6,024,507 A 2/2000 Joulia ..... 401/4

FOREIGN PATENT DOCUMENTS

EP 0 325 766 A3 8/1989 ..... A45D/34/04
GB 1 393 823 4/1973 ..... B01F/7/20

* cited by examiner

*Primary Examiner*—John J. Wilson
*Assistant Examiner*—Robyn Kisu Doan
(74) *Attorney, Agent, or Firm*—Renner, Kenner, Greive, Bobak, Taylor & Weber

(57) ABSTRACT

A container for liquids of the present invention, including a container body in which at least a part of an inner surface thereof, which defines an inner space storing therein a liquid using coloring matter, such as a pigment and a dye and/or containing a particulate or fibrous or similar additive element, is formed of a curved surface having an arcuate cross-sectional shape and a transparency; and a wiper unit inserted and housed in a liquid storage portion of the container body so that the wiper unit can be turned, and having at least one wiper element which extends along the inner surface of the container body, and which can be turned in a circumferential direction along the curved inner surface, the wiper element being formed of a comparatively rigid base portion, and a wiper member fixed to the base portion, adapted to elastically contact the inner surface of the container body during a turning movement of the wiper and capable of substantially completely wiping off a liquid deposited on the curved inner surface.

11 Claims, 15 Drawing Sheets

(a)

(b)

CONTAINER FOR LIQUIDS

BACKGROUND OF THE INVENTION

1. Field of the Invention

This invention relates to a container for liquids, and more particularly to a container for liquids, adapted to hold a liquid using coloring matter and/or containing particulate or fibrous or similar additive elements, or a liquid the components of which are readily separated.

2. Description of the Related Art

For example, mascara and the like are stored generally in a brush-carrying container, and applied to an object part of a body by using a brush fixed to a cap. However, as the time elapses, the components of the content of the container separate from each other. Consequently, components of a low viscosity gather in a central portion, into and out of which the brush is inserted and drawn, of a bottle, and components of a high viscosity are liable to be deposited on an inner surface of the bottle. In this condition, the content of the container cannot be even agitated by the brush since an opening of the container of this kind is small, and the liquid cannot be used even when the quantity thereof is satisfactorily large.

The known containers which have solved such problems include containers disclosed, for example, in Japanese Utility Model Publication Nos. 12681/1991 and 45623/1992.

Namely, the container for mascara and the like disclosed in Japanese Utility Model Publication No. 12681/1991 is a container including a brush-carrying cap, and a substantially cylindrical bottle, the container being further provided with locking portions on a shaft of the brush, and an agitation member extending along a substantially cylindrical inner surface of the bottle, adapted to engage the locking portions when the brush is inserted into the bottle, and adapted to be turned when the cap is turned, scrape a deposited portion of the liquid from the inner surface of the bottle, deposit the liquid thus scraped from the same inner surface on the brush and stir the deposited liquid into the liquid in the bottle.

The cosmetics applicator-carrying container disclosed in Japanese Utility Model Publication No. 45623/1992 includes a turning plate provided at a mouth portion of a container body so that the plate can be turned, a non-circular applicator-rod-inserting hole formed in a central portion of the turning plate, an applicator rod inserting cylinder provided on a lower side of the turning plate, an upper communication hole provided in the portion of the applicator rod inserting cylinder which is in the vicinity of an upper end thereof, a lower communication hole provided in the portion of the applicator rod inserting cylinder which is in the vicinity of a lower end thereof, an inclined plate provided in an annular storage portion formed between the container body and applicator rod inserting cylinder; adapted to be turned and transfer the cosmetics in the axial direction of the cylinder; and connected to the turning plate so that a turning force of the turning plate is transmitted to the inclined plate, a cap fitted around the mouth portion of the container body and provided with the applicator rod suspended from a lower surface of the cap, and an applicator attached to a free end portion of the applicator rod, the applicator rod being inserted slidably in the non-circular applicator-rod-inserting hole of the turning plate so that the applicator rod cannot be turned therein, the inclined plate being turned by a turning movement of the applicator rod.

It is preferable that a container for cosmetics, such as the mascara, a manicure liquid and the like be transparent so as to ascertain that a color of the cosmetics is beautiful, and so as to ascertain a residual quantity thereof. In recent years, lame-containing cosmetics and two-color marbled cosmetics have been becoming popular, it has come to be specially preferable that the container be transparent so that the content thereof can be seen.

However, when such containers as are disclosed in these two publications are made transparent, the cosmetics deposited sporadically, i.e., in a spotted state on the inner surface of the containers are seen through the walls of the container bodies since the scraping (by the agitation member disclosed, for example, in Japanese Utility Model Publication No. 12681/1991) of such deposited cosmetics from the inner surface of the container body is not perfectly done. This spoils the beauty of the containers, so that there have not heretofore been a transparent container for such cosmetics as mentioned above.

SUMMARY OF THE INVENTION

The present invention has been made in view of the above-mentioned circumstances, and provides a container for liquids, capable of excellently carrying out the scraping of a liquid deposited on an inner surface of the container therefrom while excellently carrying out the agitation of the liquid, for example, a colored liquid stored in the container, and capable of ascertaining the kneaded condition of the liquid in the container and the quantity of used liquid.

A container for liquids of the present invention, including a container body in which at least a part of an inner surface thereof, which defines an inner space storing therein a liquid using coloring matter, such as a pigment and a dye and/or containing a particulate or fibrous or similar additive element, is formed of a curved surface having an arcuate cross-sectional shape and a transparency; and a wiper unit inserted and housed in a liquid storage portion of the container body so that the wiper unit can be turned, and having at least one wiper element which extends along the inner surface of the container body, and which can be turned in a circumferential direction along the curved inner surface, the wiper element being formed of a comparatively rigid base portion, and a wiper member fixed to the base portion, adapted to elastically contact the inner surface of the container body during a turning movement of the wiper and capable of substantially completely wiping off a liquid deposited on the curved inner surface.

In the container for liquids, the container body is preferably provided at an upper portion thereof with a cap capable of being put on and removed from the container body by turning, the wiper being adapted to be operated by at least one of cap-fitting and cap-removing turning movements.

The cap is preferably inserted into the interior of the container body and provided with a member for taking out a predetermined quantity of the liquid.

The wiper member is preferably formed of a soft synthetic resin or rubber. The liquid take-out member may be a cosmetics applicator.

The container body may be of the type which does not have an opening besides an opening, a diameter of which is smaller than that of a trunk portion of the container body, provided at an upper portion thereof, the wiper being inserted in a compressed or folded state from the opening into the interior of the container body and rendered capable of contacting the curved inner surface of the container body when the wiper is spread out.

The wiper unit is preferably formed as a unit by connecting plural wiper elements at lower or upper portions thereof to a wiper body by flexible members or hinges, the unit being thereby made foldable. Further, the wiper unit is preferably formed as a unit by connecting plural wiper elements at lower or upper portions thereof to a wiper body by a spring member, the unit being thereby made compressible.

The wiper member of the wiper unit is preferably engaged with the curved inner surface of the container body only when the curved inner surface is wiped therewith, and disengaged therefrom during the time other than the curved inner surface wiping time.

The liquid maybe a high-viscosity liquid. Further, the liquid may be a separated type liquid formed of not less than two kinds of liquids. The liquid may be cosmetics. The additive element may be a bubbly material, lame or microcapsules.

The wiper elements mentioned above can be manufactured by molding a base portion and a wiper member in a body or as two parts, or by insert molding.

BRIEF DESCRIPTION OF THE DRAWINGS

FIG. 11 is a drawing of a wiper unit made foldable, wherein

FIG. 11A is a plan view,

FIG. 11B a front view, and

FIG. 11C a bottom view;

FIG. 12 is a drawing showing the wiper unit of FIG. 11 in a folded state, wherein FIG. 12A is a plan view, and FIG. 12B a front view;

DETAILED DESCRIPTION OF THE INVENTION

Figure 1:
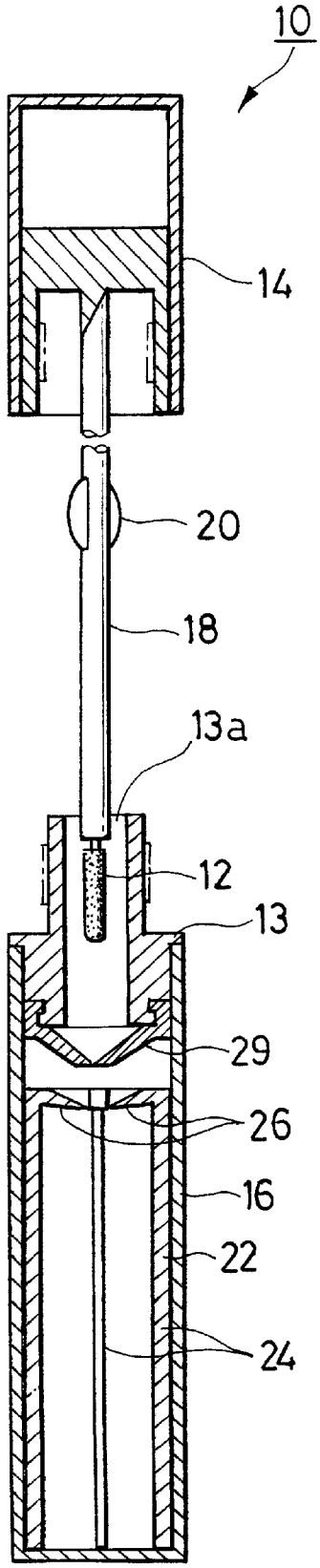
FIG. 1 is a longitudinal sectional view showing an embodiment of the container for liquids according to the present invention with an applicator in a drawn-out state.
Figure 2:
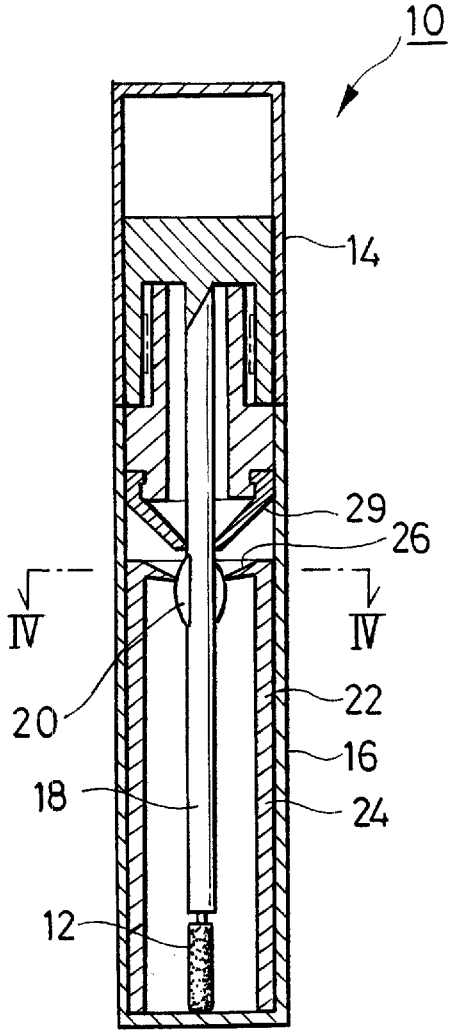
FIG. 2 is a longitudinal sectional view showing the container for liquids of FIG. 1 with the applicator in an inserted state.
Figure 4:
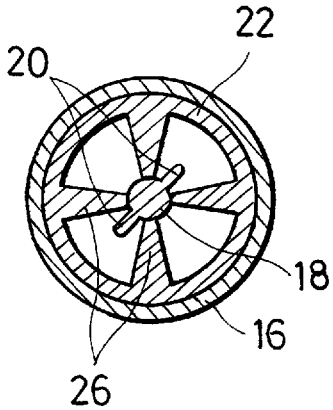
FIG. 4 is a sectional view taken along the line IV—IV in FIG. 2.
Figure 3:
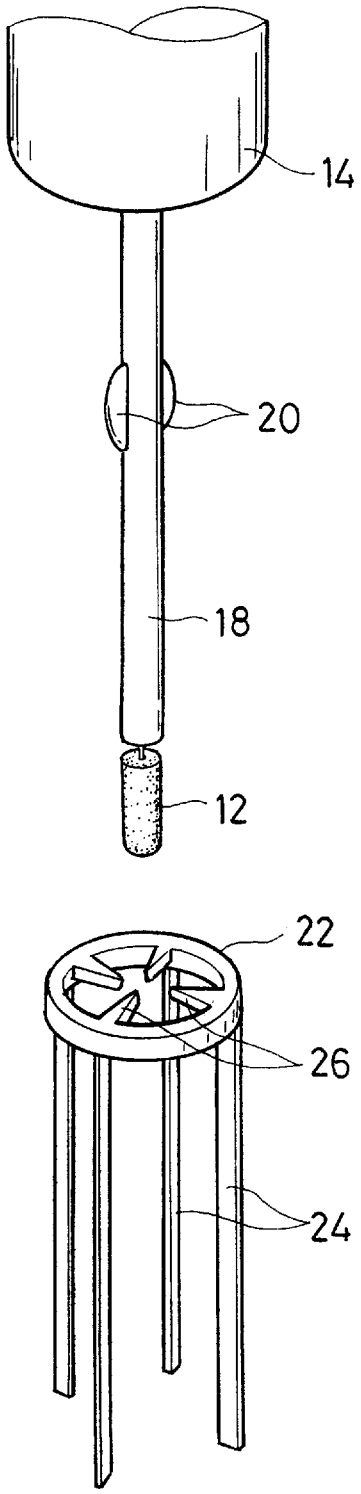
FIG. 3 is a perspective view showing a cap and a wiper unit for the container for liquids shown in FIG. 1.

In this container, a wiper element extending over substantially the whole height of an inner curved surface of a liquid storage portion of a container body and, moreover, capable of being turned in the circumferential direction along the curved inner surface is provided, and this wiper element is formed of a comparatively rigid base portion, and a wiper member fixed to the base portion, and adapted to elastically contact the curved inner surface of the container body when the wiper unit is turned, and thereby substantially completely wipe off a liquid, for example, a liquid deposited on the same inner surface. Therefore, when the wiper element is turned circumferentially along the curved inner surface by a turning force of a cap, the wiper member of the wiper element elastically contacts the curved inner surface during a turning movement of the wiper element, this enabling a liquid deposited on the curved inner surface to be scraped off substantially completely, and also the deposited liquid to be stirred into the liquid in the container body excellently.

Moreover, a body of the container according to the present invention is transparent at at least the portion thereof which corresponds to the curved inner surface, so that the liquid agitating condition can be observed clearly. Therefore, when a liquid stored is, for example, two-color mixed cosmetics, a mixing operation is stopped when the cosmetics attain a desired mixed condition (suitably marbled), and the cosmetics in this condition can be applied to a desired part of a user's body. Accordingly, many variations of one kind of cosmetics can be enjoyed. Such an effect is noticeable, especially, in the case of cosmetics containing powder of lame and the like.

As mentioned above, in the container according to the present invention, at least a part of the container body is made transparent, and the liquid deposited on the inner surface of the container can be wiped off beautifully with the wiper, so that it becomes possible to keep the inner surface clean, and ascertain a residual quantity of the cosmetics at sight.

DESCRIPTION OF THE PREFERRED EMBODIMENTS

The container for liquids according to the present invention will now be described concretely on the basis of its embodiment and with reference to the attached drawings.

This container 10 for liquids is provided with a container body 16 in which at least a part of a wall thereof forming a liquid storage inner space is formed of a wall having curved inner surface of an arcuate cross-sectional shape, at least the portion of the wall which has the curved inner surface being made transparent. Namely, this container body 16 may have any outer shape as long as it has a cylindrical inner space (a part of the inner space may have a shape of a part of a cylinder). It is the matter of course that the container as a whole may be transparent. The liquid is a single liquid or a double liquid or a multi-liquid, especially, a high-viscosity liquid which use a coloring agent, such as pigment, a dye and the like or containing other kinds of additive elements. Such liquids may include cosmetics, such as eye-liner, mascara, eye shadow, eyebrow pencil, rouge, foundation, hair dye, etc. as well as poster color, correction liquid so-called "white". The additive elements mentioned above maybe any kind of elements, such as fibrous, granular, bubbly or similar elements, or lame or other elements similar thereto. The granular elements may be microcapsules containing some material therein.

A cap 14 having an applicator 12 is provided in an upper mouth portion of the container body 16 so that the cap 14 can be fitted fixedly therein by screwing. The applicator can be formed of a brush, etc. or a syringe.

A shaft 18 of the applicator 12 is provided with locking portions 20 formed of plate members projecting outward. The container body 16 is provided therein with a wiper unit 22 fitted and housed therein so that the wiper unit can be turned. This wiper unit 22 is provided with wiper elements 24 extending longitudinally along the inner surface of the container body 16. Although the wiper elements 24 usually extends longitudinally over substantially the whole length of the inner surface of the container body 16, they may extend over a part of the length of the inner surface depending upon an object of providing the same.

Each of the wiper elements 24 (refer to FIG. 5) is formed of a comparatively rigid base portion 26, and a wiper member 28 fixed to the base portion 26, adapted to elastically contact the inner surface (a part of the inner surface when the inner surface is partially formed) when the wiper 22 is turned, and capable of substantially completely wiping off a liquid deposited on the inner surface. The wiper element 24 can be manufactured by molding the base portion and wiper member in a body or separately, or by insert molding the same. In FIGS. 1–4, the wiper member is shown as one member for simplifying the illustrations.

Figure 5:
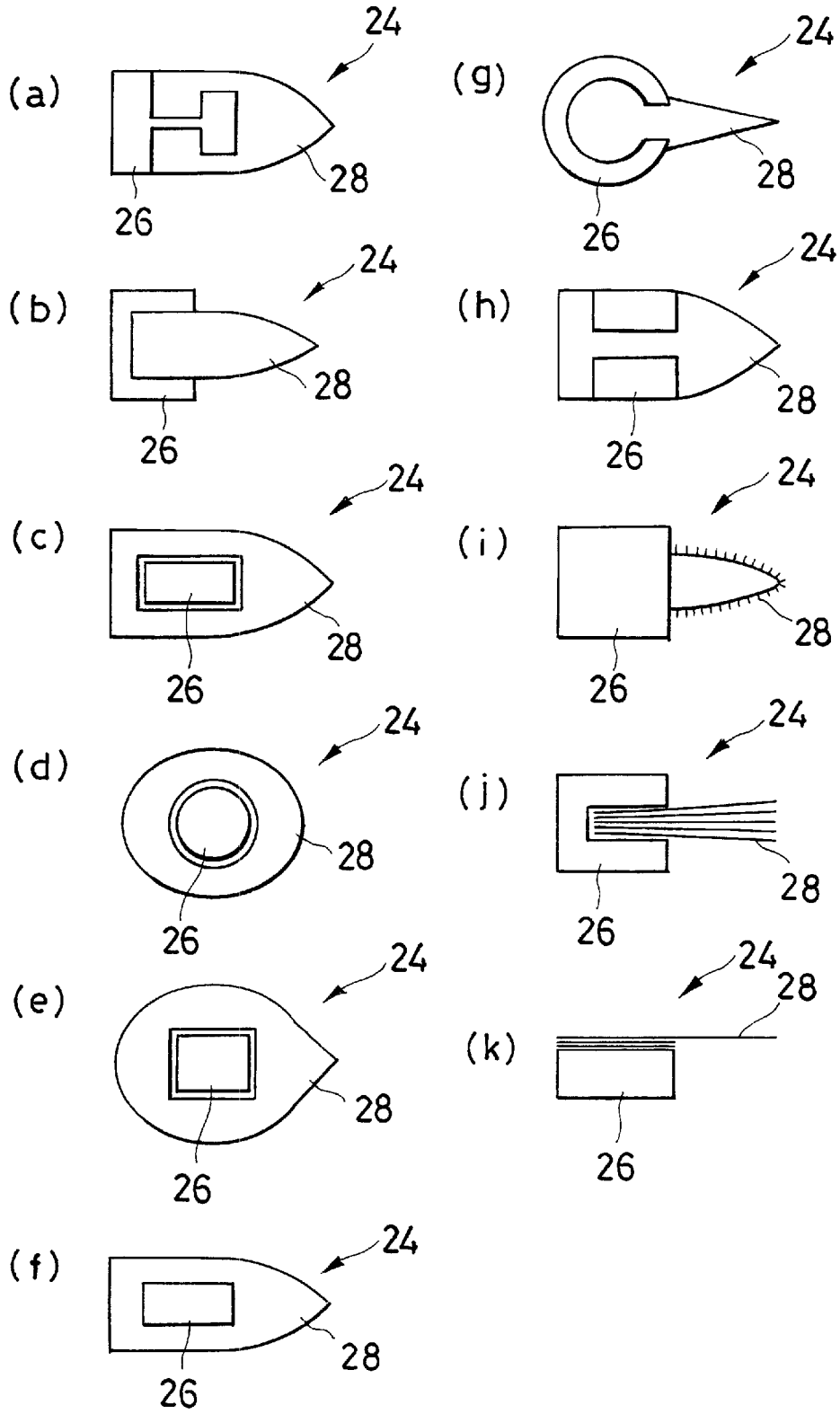
FIG. 5 is a cross-sectional view showing examples of the construction of wiper elements.

It is preferable that the base portion 26 be formed out of, for example, a metal, a hard resin or a hard material of a hardness of not lower than 80°, and that the wiper member 28 be formed out of a soft resin, rubber of a hardness of lower than 80°, fiber, a brush, planted hair, a foam (sponge), a synthetic resin film and the like. FIG. 5 shows examples of cross-sectional shapes of the wiper elements 24. FIGS. 5A, 5B, 5C, 5D and 5E show examples in each of which a base portion 26 and a wiper member 28 are molded separately and then engaged with each other, FIGS. 5F and 5G examples in each of which a base portion 26 and a wiper member 28 are molded in one body by internal chilling and the like, FIG. 5I an example in which a wiper member 28 is formed of planted hair, FIG. 5J an example in which a wiper member 28 is formed of a brush, and FIG. 5K an example in which a wiper member 28 is formed of a film, respectively.

The wiper unit 22 is provided at its upper end with arms 27 projecting with a hollow space, through which the shaft 18 of the applicator 12 passes, left on an inner side of the arms. This wiper unit 22 and locking portions 20 are engaged with each other when the applicator 12 Is inserted into the container body 16 to cause the locking portions 20 to pass through a packing 29 at the mouth portion of the container body 16 and advance among the arms 27. When the cap 14 is turned so as to put the cap on the container body 16 or remove the cap therefrom, the wiper unit 22 is also turned.

Therefore, when the cap 14 of this container 10 is turned, the portion of the liquid stored in the interior of the container body which is deposited on the inner surface thereof can be wiped off by the wiper members 28, deposited on the brush extending in the central portion of the container body, and stirred into the stored liquid at the same time. This enables the liquid in the container body to be used immediately even when the liquid has been put in a separated condition. When the locking portions are arranged as in this embodiment so that the liquid is stirred when the cap 14 is fitted on or removed from the container body, the liquid as a whole in the container body is necessarily stirred every time the liquid is used. This enables an effect in preventing the occurrence of separation of the liquid in the container body to be obtained.

Figure 6:
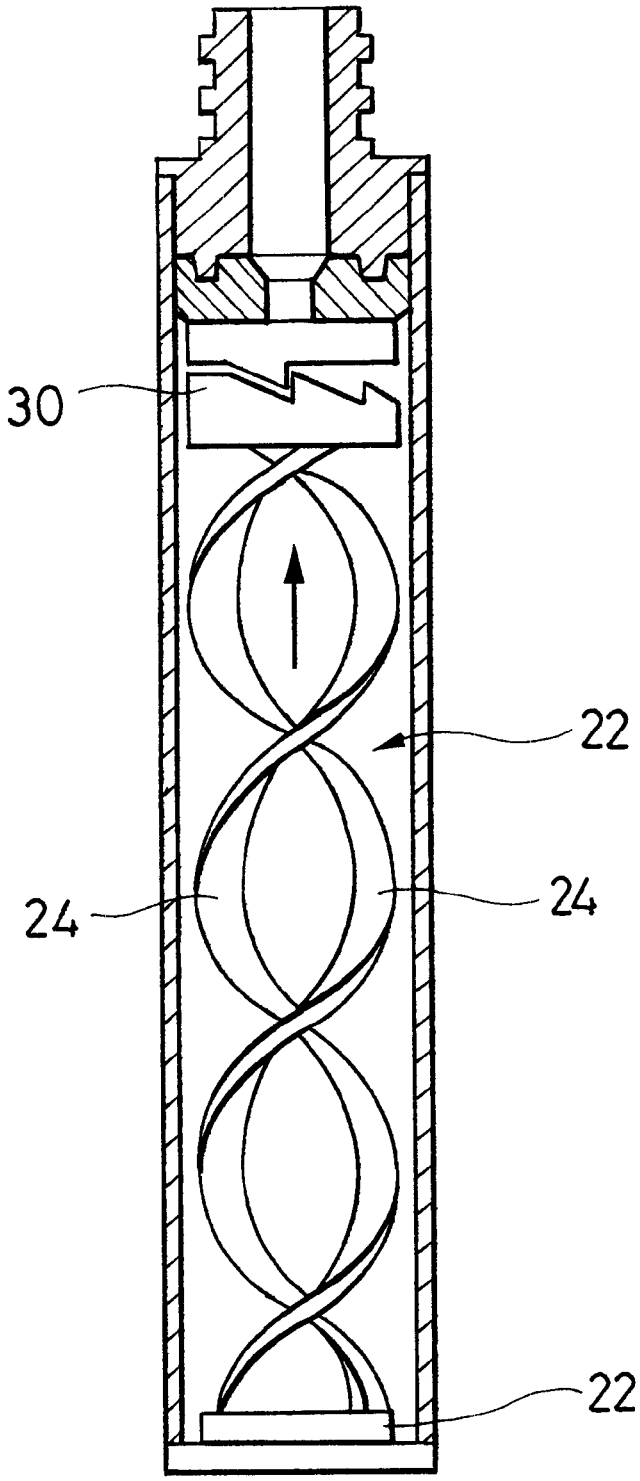
FIG. 6 is a longitudinal sectional view of a principal portion of an example in which wiper elements are helically formed.
Figure 7:
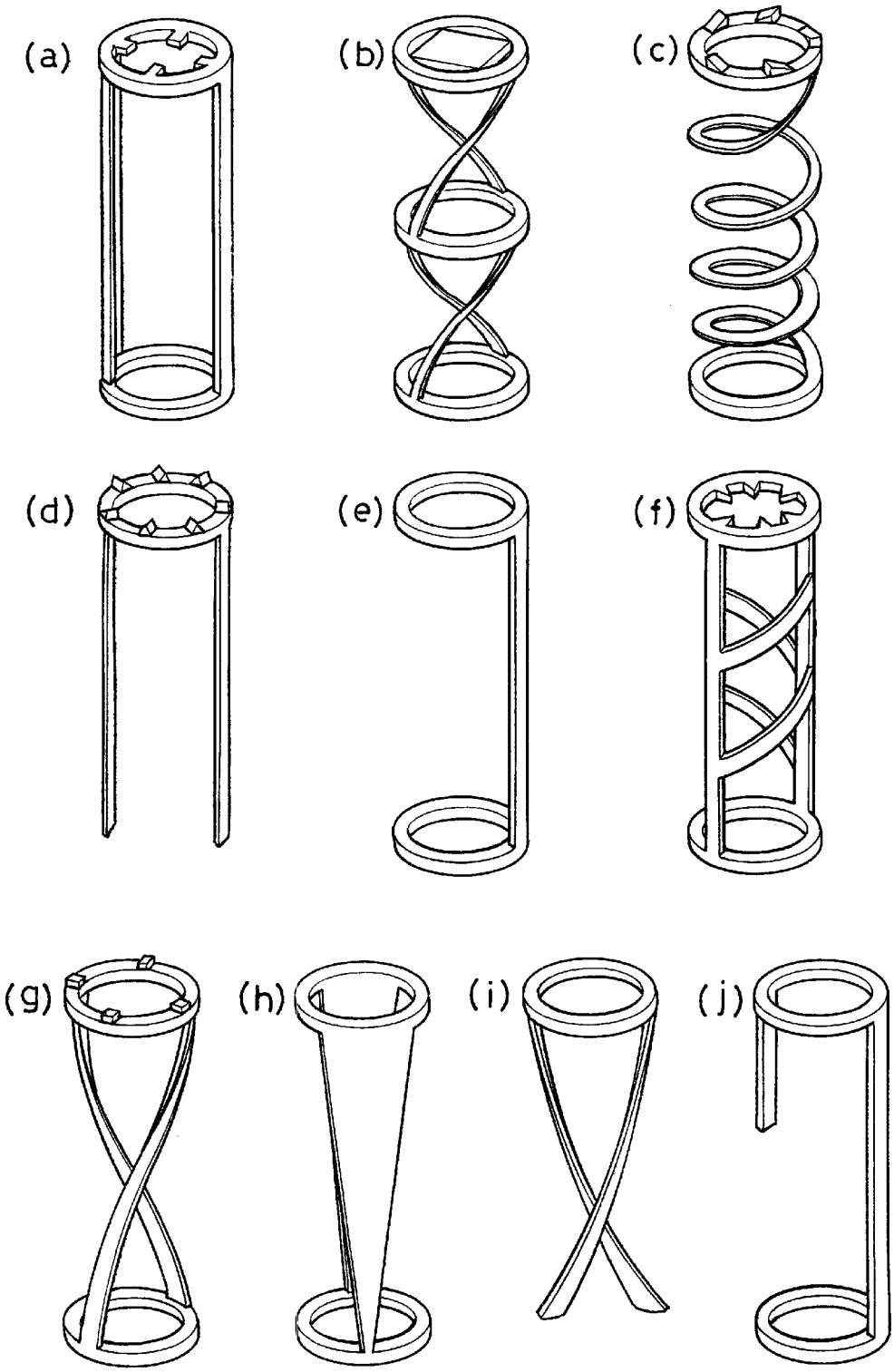
FIG. 7 is a perspective view showing examples of the construction of wipers.

The wiper elements 24 of the wiper unit 22 can be formed of helical wiper elements as shown FIG. 6. When the wiper unit 22 in which the wiper elements 24 are formed helically in this manner is turned to left, a force for raising a precipitated portion of the liquid in the container body 16 occurs, so that an efficient agitation of the liquid can be carried out. Therefore, an example shown in FIG. 6 is formed by providing a ratchet unit 30 in a position, in which the above-mentioned arms 27 are provided, in such a manner that the wiper unit 22 can be turned to left only. This ratchet unit 30 is also formed so as to be operated in accordance with a turning movement of a cap (not shown in FIG. 6) just as in the above example. Accordingly, in the example shown in FIG. 6, the wiper unit 22 is turned when the cap is turned so as to be opened, and not turned when the cap is turned so as to be closed. Differently from this case, the liquid can also be made to flow downward by turning the wiper elements 24 reversely. Namely, when helical elements are used as wiper elements 24, collecting the liquid in the upward direction and collecting the liquid in the downward direction can be selected arbitrarily by selectively deciding the direction in which the wiper elements are turned or the direction in which the helical bodies of the wiper elements extend.

The wiper may have any other structure than the structure described above. The examples of the structure of the wiper unit are shown in FIGS. 7A–7J.

In the above-described embodiment, the container 10 is assembled by housing the wiper unit 22 in the container body 16, and then fitting the plug 13 having a comparatively narrow opening in the container body. However, in the case of a container body 40 of a mode in which an opening is not provided except an opening 42 which is formed at an upper portion of the container body, and which has a diameter smaller than that of a trunk portion of the container body as shown in FIG. 8, i.e., in the case of a container body of a mode which is formed of a so-called "blow bottle", the wiper unit of the above-mentioned form cannot be housed as it is in the container body.

Therefore, in the following embodiment, a wiper unit is made compressible or foldable so that the wiper unit can be housed in a dimension-reduced state in a container body.

Figure 8:
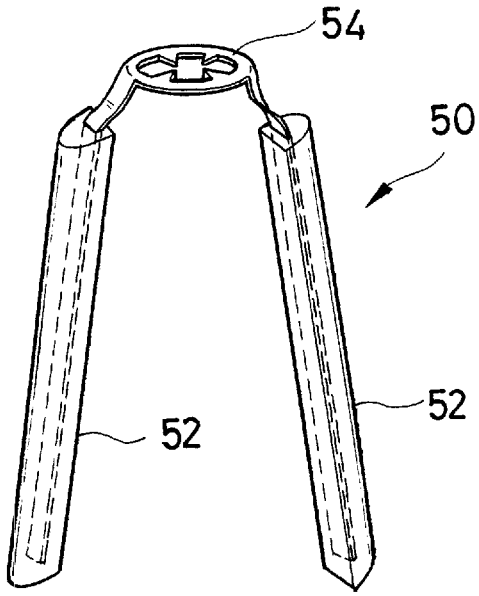
FIG. 8 is a schematic perspective view showing an example of a wiper unit made bendable (compressible)
Figure 8:
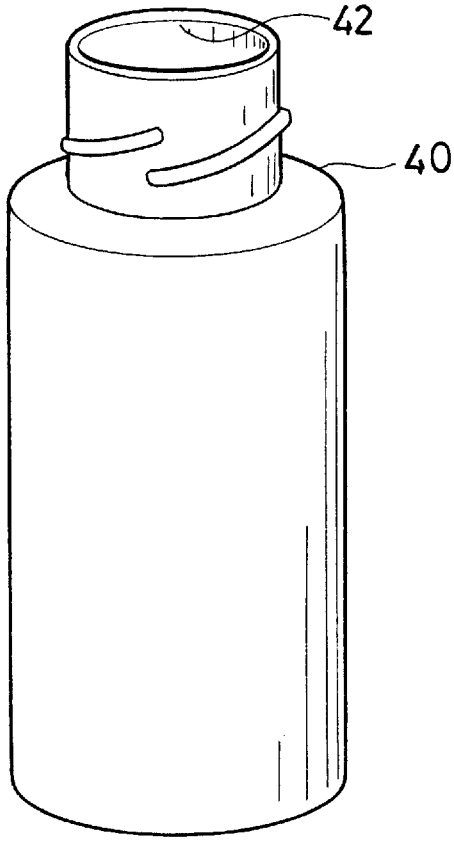

A wiper unit 50 of FIG. 8 is formed by connecting two wiper elements 52 together by a connecting member 54 formed out of an elastic material, such as a metal or a resin which can restore after it is bent its original form automatically owing to its elastic power when the elastic material is released from a bending force. It is preferable that this connecting member be provided with such arms 26 and the like as are shown in FIGS. 1–4, to form a transmission device for transmitting the rotational force of a cap to the wiper. The wiper elements 52 may have any of the above-described structures.

Figure 9:
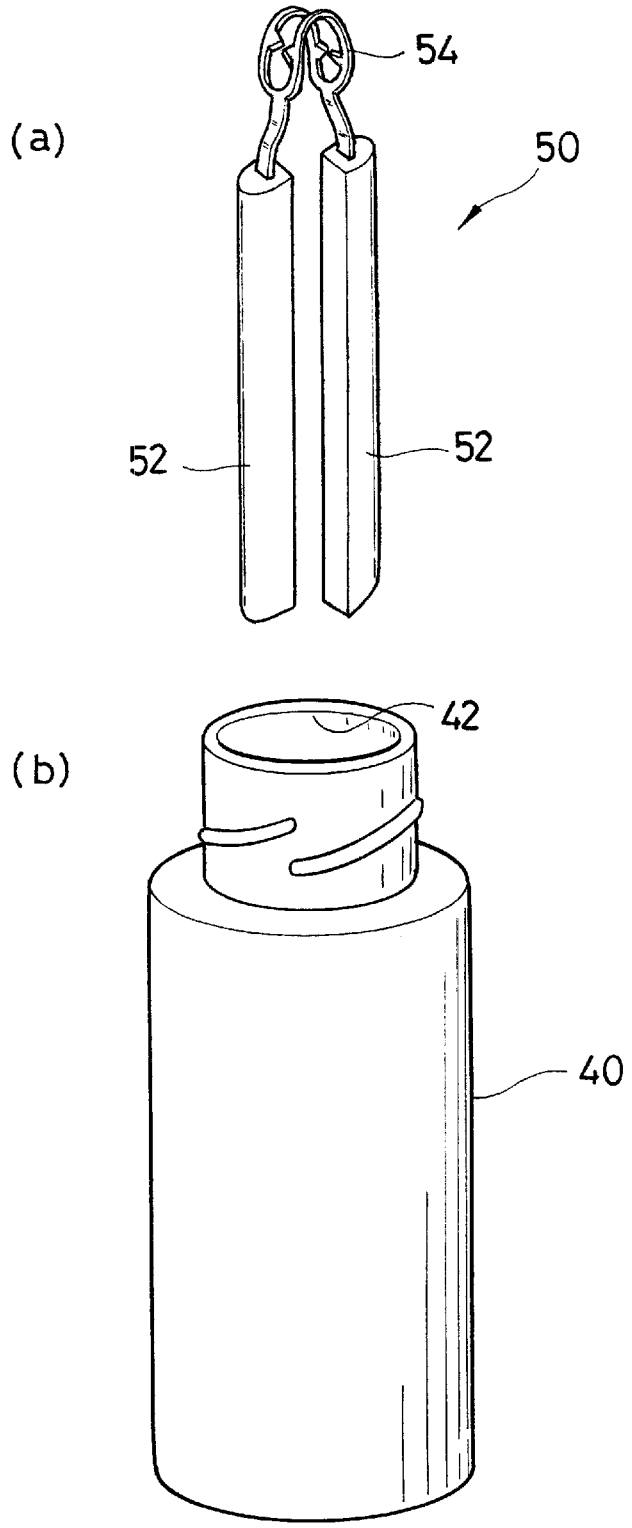
FIG. 9 is a schematic perspective view showing the wiper member of FIG. 8 in a bent (compressed) state.

The wiper unit 50 of FIG. 8 is bent (compressed) at a portion of the connecting member 54 as shown in FIG. 9.

The wiper unit in this condition is inserted into the container body 40 through the narrow opening 42. When the wiper unit 50 is released from a bending force, it is housed fixedly in the container body 40 as shown in FIG. 10.

In this embodiment, the connecting member 54 is formed out of an elastic material, so that the wiper elements 52 are urged constantly in the outward direction. Since a force for pressing the wiper elements against the container body is exerted on the wiper elements, the liquid deposited on the inner surface of the container body can be wiped off accurately with the wiper elements.

Figure 10:
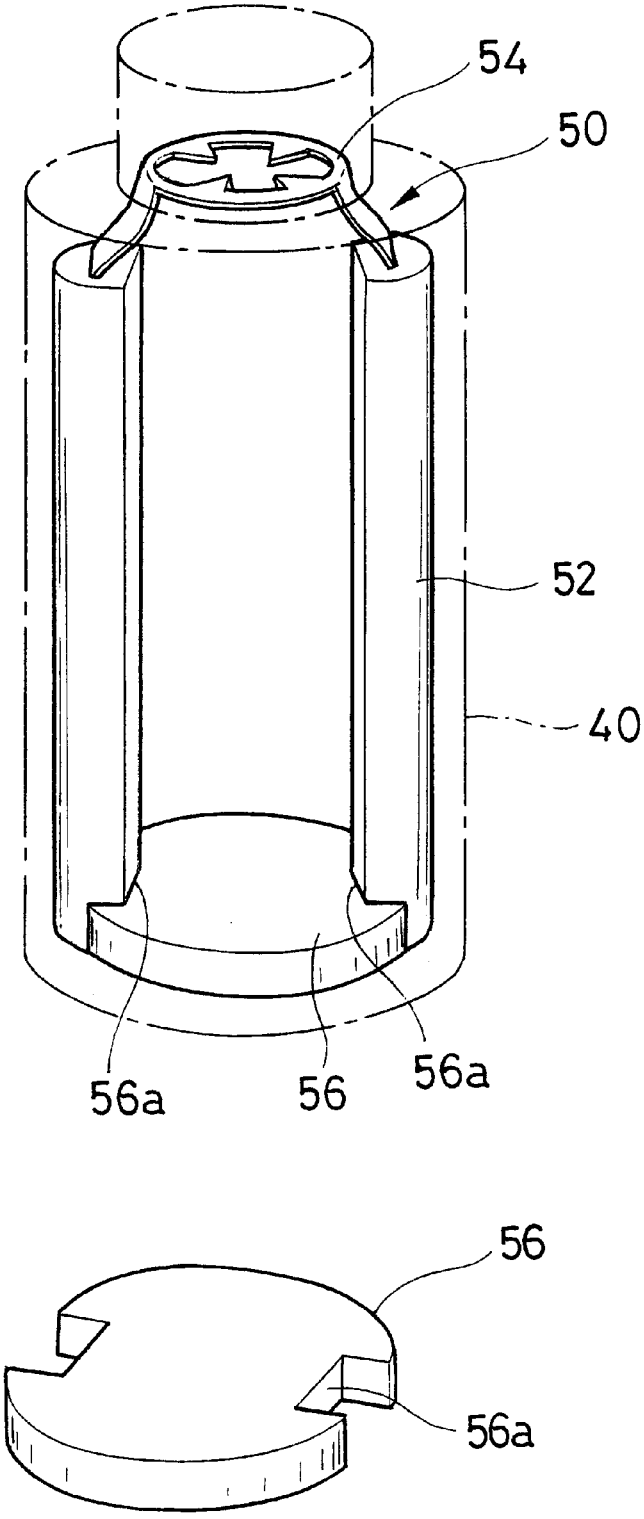
FIG. 10 is a schematic perspective view showing the wiper unit of FIG. 8 set fixedly in the container body.

In the case of this embodiment, it is preferable that an inward fall preventing plate 56 provided with recesses 56*a* in which the wiper elements 52 shown in FIG. 10 are inserted so as to prevent the wiper elements from falling inward be set in a bottom portion of the interior of the container body.

Figure 11:
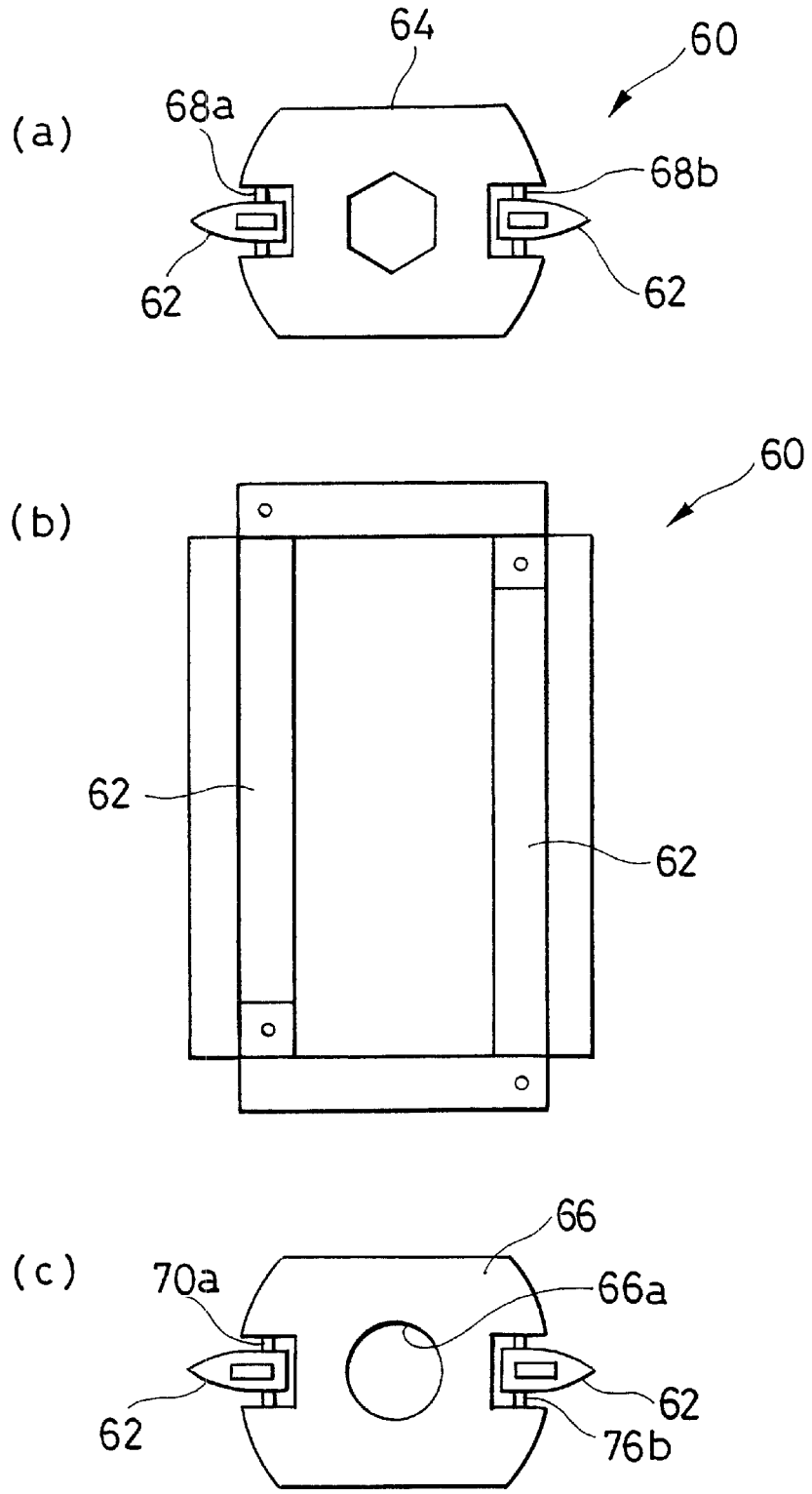
Figure 12:
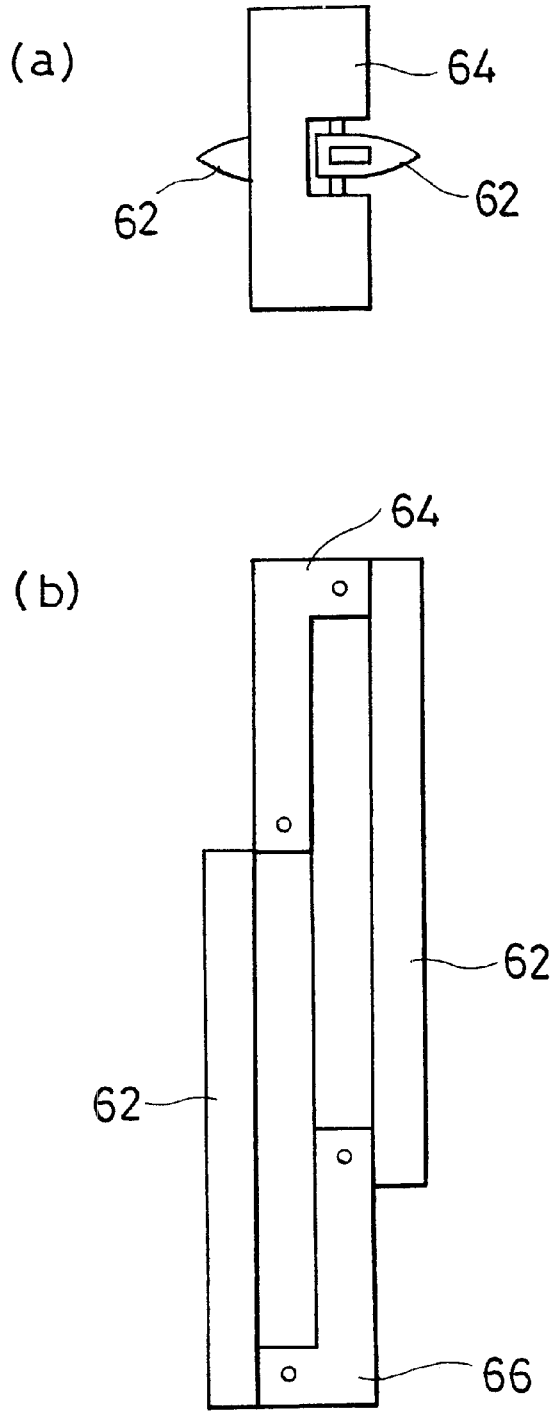

The wiper unit can also be formed to a foldable structure as shown in FIG. 11. Namely, a wiper unit 60 of FIG. 11 is provided with two wiper elements 62 the structure of which may be identical with that of the above-mentioned wiper elements 24. These two wiper elements 62 are fastened at their respective upper and lower end portions to upper and lower connecting members 64, 66 via hinges (pivots) 68*a*, 68*b* and hinges (pivots) 70*a*, 70*b*. The wiper unit 60 or the structure shown in FIG. 11 is made foldable as shown in FIG. 12, owing to the above-mentioned structure. The wiper unit in this folded state is inserted into a container body 40 in the same manner as in the above-mentioned example, and then spread out as shown in FIG. 11, to put the wiper in an operating condition. Unlike the case of the connecting member in the example of FIG. 8, an elastic force is not exerted on the connecting members of FIG. 11. Therefore, in the case of this example, it is preferable that the lower connecting member 66 be provided with a circular opening 66*a* at a central portion thereof as shown in FIG. 11C, and that the container body 40 be provided with a circular projection (not shown), which is engageable with this opening 66*a*, in a bottom wall thereof, the engagement of the opening and projection with each other retaining an opened condition of the wiper elements 62.

Figure 13:
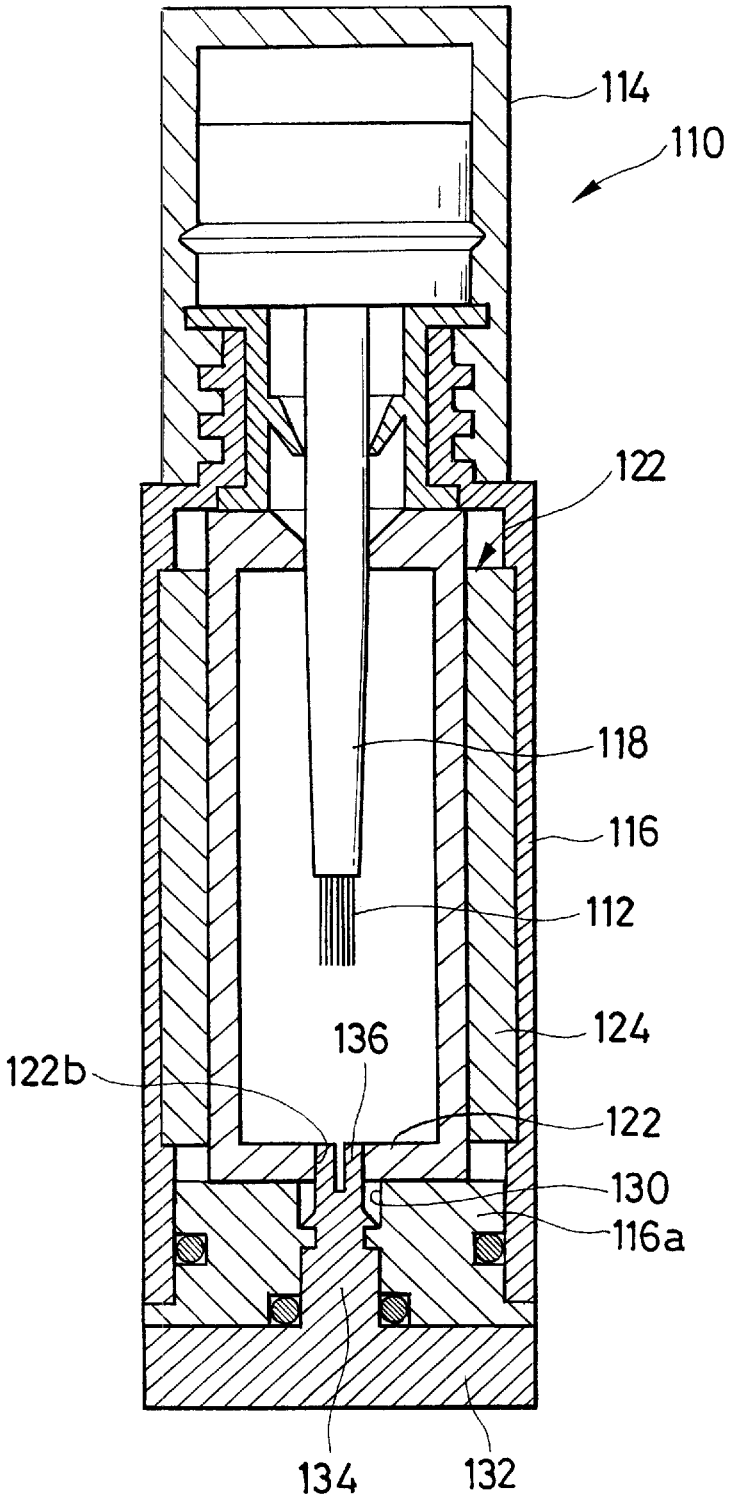
FIG. 13 is a longitudinal sectional view of an example of the container for liquids in which a wiper unit is turned by an operating ring provided at a lower portion of a container body.

Although the above are the descriptions of examples in which a wiper unit is operated by a cap, the wiper unit may also be turned by an operating ring provided at a bottom of a container body. An example of this case will now be described with reference to FIG. 13 onward.

This container 110 for liquids has a container body 116 provided with a tail plug 116*a*. A cap 114 having an applicator 112 is formed so that the cap can be fitted firmly around an upper mouth portion of the container body 116 by screwing. A shaft 118 of the applicator 112 in this example may be formed of a simple rod. A wiper unit 122 is housed in a fitted state in the interior of the container body 116 so that the wiper unit can be turned therein. The wiper unit 122 is provided with wiper elements 124 extending longitudinally over substantially the whole height of an inner surface of the container body 116. Since the construction of the wiper unit, etc. may be identical with that of the corresponding parts described heretofore except the shape of the shaft of the applicator, a further description thereof will be omitted.

Figure 14:
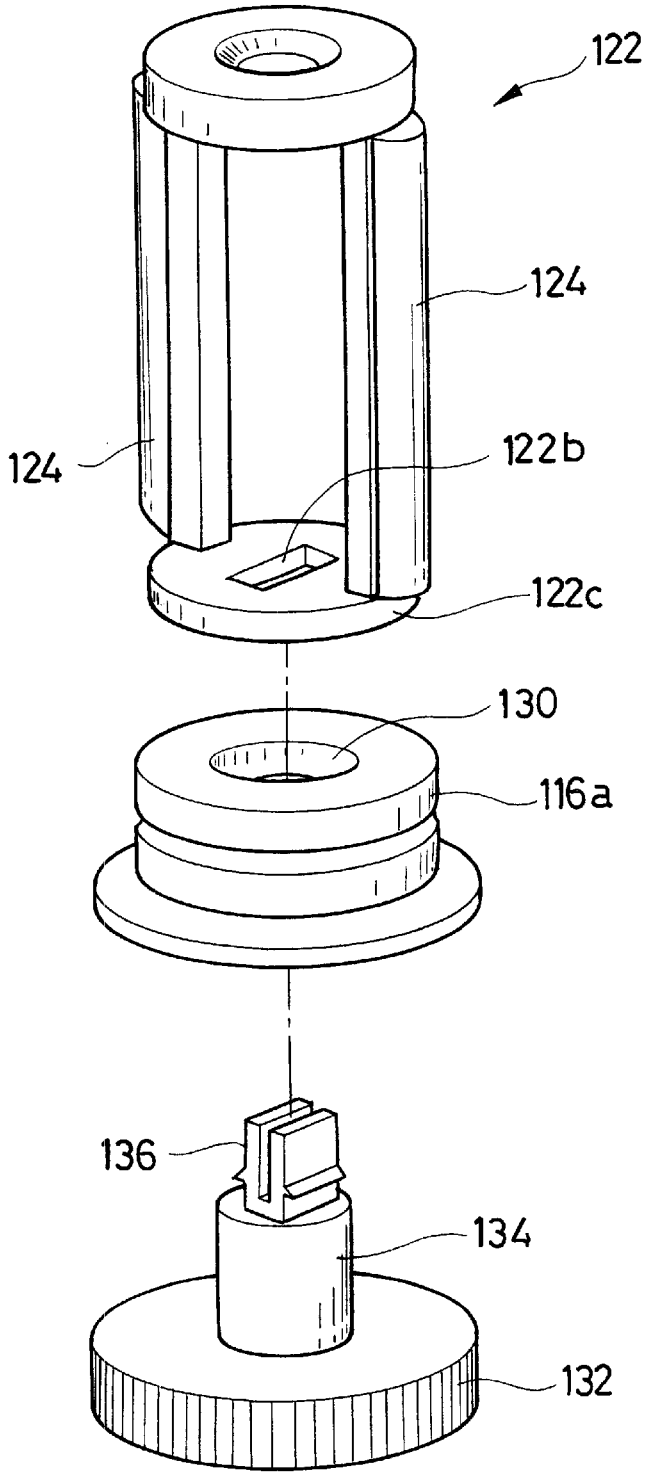
FIG. 14 is a exploded perspective view of a principal portion or the container for liquids shown in FIG. 13.

The tall plug 116*a* is provided at a central portion thereof with a through hole 130 as shown in FIG. 14. The container body 116 is provided at a lowermost portion thereof with an operating ring 132, from an upper surface of which a driving shaft 134 extends. This driving shaft 134 extends upward into the interior of the container body 116 through the through hole 130 of the tail plug 116*a*, and a locking portion 136 at an upper part of the driving shaft is engaged with a rectangular locking opening 122*b* provided in a lower connecting member 122*c* of the wiper unit 122. Owing to this structure, the wiper unit 122 can be turned by turning the operating ring 132. This example may also be formed by providing a ratchet unit therein so that, only when the operating ring 132 is turned in a predetermined direction, the wiper unit 122 is turned in the same direction.

In the container according to the present invention, the agitation members extending along the substantially cylindrical inner surface of the bottle are turned as is clear from the above embodiments. Therefore, even when the liquid is put in a separated state, it can be set homogeneous again by agitating the same. When the agitation members are further turned, the portion of the liquid which is deposited on the inner surface of the container body is immediately scraped off and deposited on the brush. Accordingly, the liquid becomes able to be used before the liquid is set homogeneous. Even in the case of a liquid containing a large quantity of high-viscosity components, such as mascara and requiring many times of agitation operations to set the liquid homogeneous, the liquid can be rendered usable in a short period of time, and a pleasant sense of use can be obtained.

Therefore, this container is suitable to store a liquid having a high viscosity, liable to be deposited on the inner surface of a bottle, and readily separated into not less than two components when left as it is, such as mascara.

As is clear from the above embodiments, when the wiper elements in the container for liquids according to the present invention are turned circumferentially along the inner surface of the container body by a turning force of the cap, the wiper members of the wiper elements elastically contact the same inner surface during the turning of the wiper elements, and this makes it possible not only to substantially completely scrape off the liquid deposited on the inner surface of the container body but also to excellently stir the resultant liquid into the liquid stored in the container body.

Moreover, since the body of the container according to the present invention is transparent, the liquid agitating condition can be observed clearly. Therefore, for example, when a liquid stored in the container body is two-color mixed type cosmetics, the mixing of the cosmetics is stopped when the cosmetics attain a desired mixed condition (suitably marbled condition), the liquid being able to be applied as it is to a desired part of a user's body. Accordingly, many variations of one kind of cosmetics can be enjoyed. This effect is noticeable, especially, in the case of cosmetics containing powder of lame and the like. It is also possible for a user to select a color of cosmetics, put a pigment of the selected color into the container by herself, agitate the resultant cosmetics while observing the same from the outside of the transparent container and thus make cosmetics of a user's favorite color by herself.

In the container according to the present invention, the container body is transparent as described above, and, in addition, the liquid deposited on the inner surface of the container body can be wiped off beautifully with the wiper unit. Therefore, the inner surface of the container body can be kept clean, and the residual quantity of the cosmetics can be ascertained at sight.

When the wiper elements are formed as described above, there is the possibility that the wiper members formed out of a soft resin or soft rubber are deteriorated due to actions of a chemical, alcohol, perfume, etc. contained in the liquid stored in the container, to cause the elasticity of the wiper members to lower, the capability of the wiper members of closely contacting the inner surface of the container body to become unsatisfactory, and a liquid-deposited surface scraping effect to become incomplete. It is considered that the reason for the above resides in that, even when the wiper elements in this structure are not used, the wiper members of the wiper elements continue to be pressed against the inner surface of the container. Therefore, in order to solve this problem, it is recommended that the wiper members of the wiper unit be formed so that the wiper members contact the curved inner surface of the container body only when the same surface is subjected to a wiping operation with the wiper members separated from the same surface during the time other than the time for conducting the inner surface wiping operation.

Figure 15:
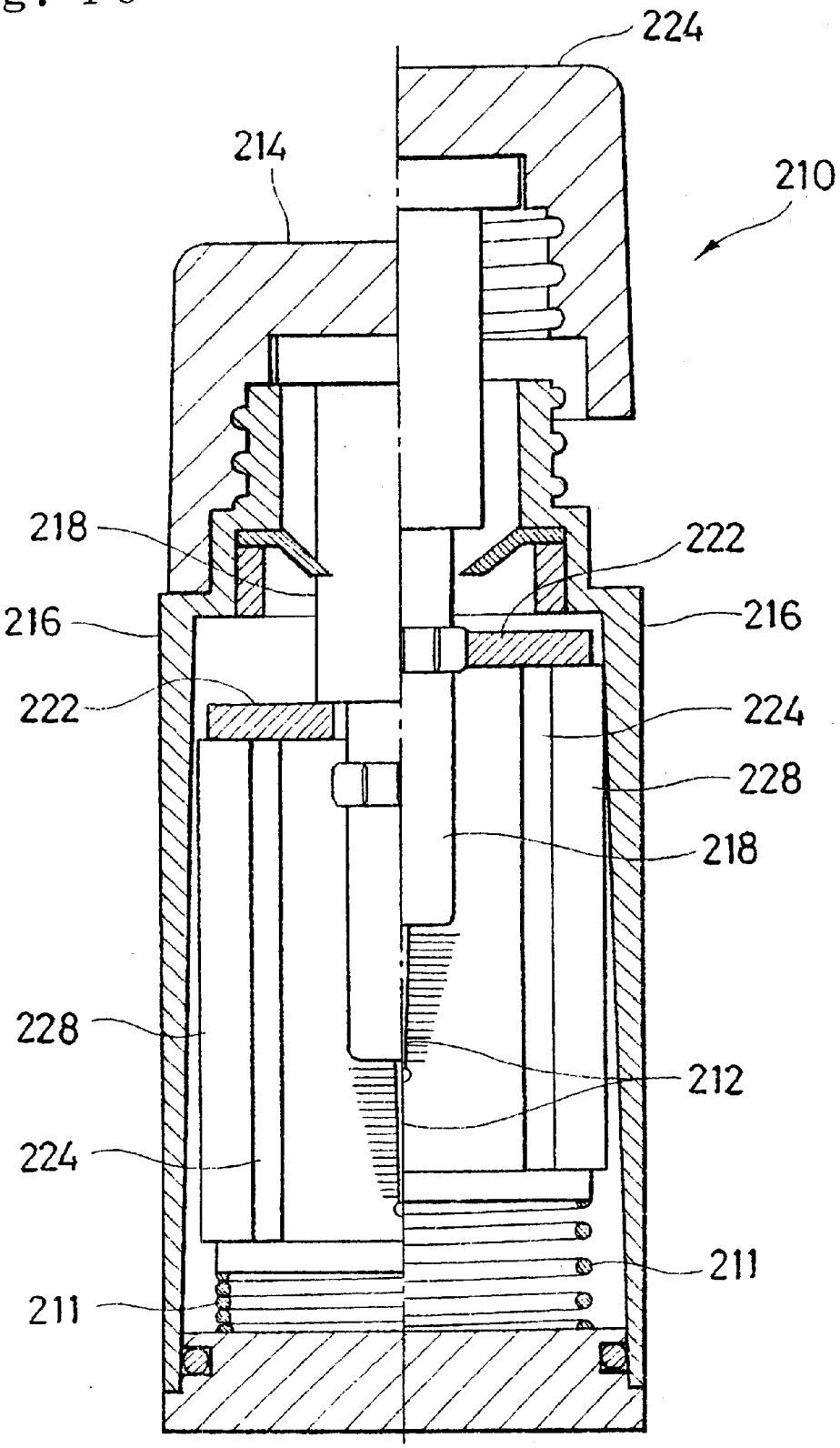
FIG. 15 is a longitudinal sectional view of an example of the container for liquids, formed so that wiper members of wiper elements can be brought into close contact with an inner surface of a container body only when a wiper unit is operated, a left half of the drawing showing the wiper members separated from the inner surface or the container body, a right half thereof showing the wiper members brought into close contact with the same inner surface.

An example of this structure is shown in FIG. 15. In FIG. 15, a left half shows a non-operating condition of wiper elements with a cap put on a container body, and a right half the wiper elements turned with the cap drawn up.

Figure 16:
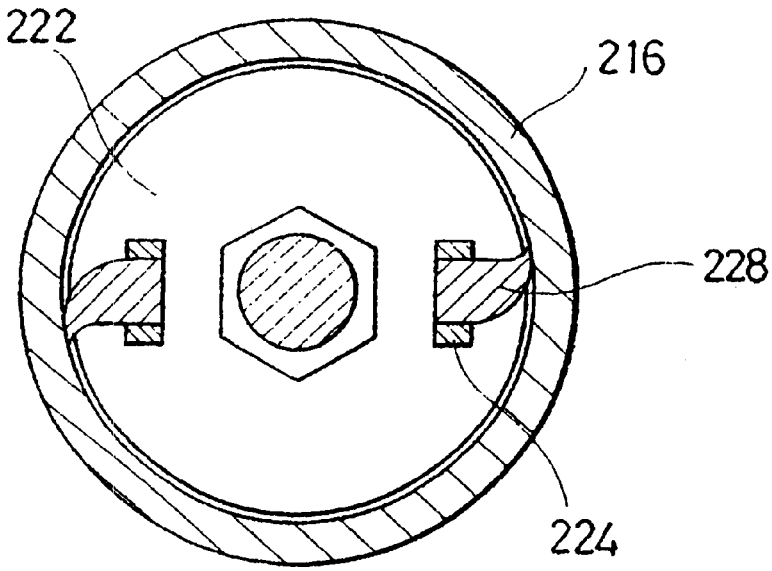
FIG. 16 is a cross-sectional view of the container body in the condition shown in the right half of FIG. 15.
Figure 17:
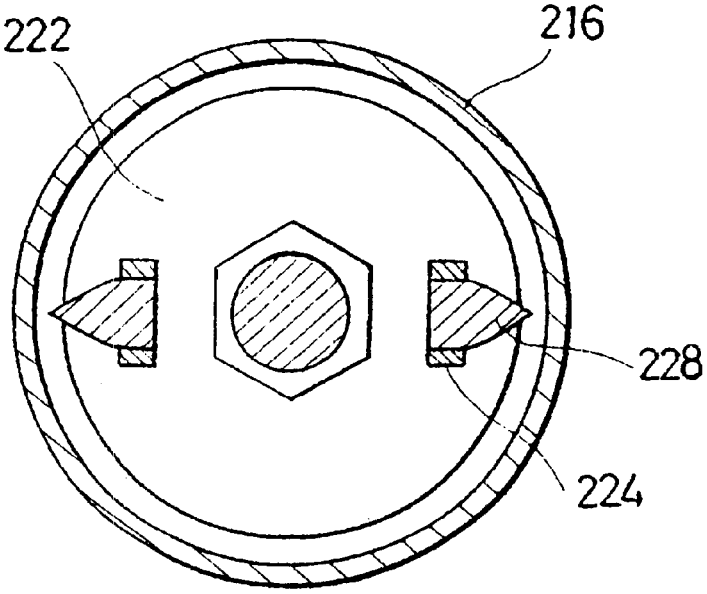
FIG. 17 is a cross-sectional view of the container body in the condition shown in the left half of FIG. 15.

In a container 210 for liquids in this example, the length of wiper elements 224 of a wiper unit 222 is set smaller than the height of the container body 216, so that the wiper elements 224 can be moved vertically in the interior of the container body 216. The inner diameter of the container body 216 is reduced gradually in the downward direction. When the wiper elements 224 are moved up and stopped in an upper position (shown in the right half of FIG. 15), wiper members 228 of the wiper elements 224 contact (refer to FIG. 16) the inner surface of the container body 216. When the wiper elements 224 are moved down and stopped in a lower position (shown in the left half of FIG. 15), the wiper members 228 of the wiper elements 224 do not contact (refer to FIG. 17) the inner surface of the container body 216.

This example is formed as described above. Accordingly, a spring 211 is provided on a lower portion of the wiper 222 so as to urge the wiper unit upward, and the thickness of a shaft 218 of an applicator 212 is set comparatively large at an upper portion thereof, and comparatively small at a lower portion thereof so as to form a stepped portion 218*a* at an intermediate portion thereof. Owing to this structure, when the cap 214 is put on the container body 216 firmly to cause the wiper unit 222 to be pressed down against the spring 211, the wiper unit 222 can be maintained in a position shown in the left half of FIG. 15.

In this example described above, the wiper members are brought into close contact with the inner surface of the container body only when the wiper unit is operated, and separated from the same inner surface when the wiper unit is not operated. Therefore, the permanent set in fatigue of the wiper members rarely occurs, so that the endurance of the wiper members becomes high.

What is claimed is:

1. A container for liquids, which are high-viscosity liquids, comprising a container body in which at least a part of an inner surface thereof, which defines an inner space storing therein a liquid using coloring matter, such as a pigment and a dye and/or containing a particulate or fibrous or similar additive element, is formed of a curved surface having an arcuate cross-sectional shape and a transparency; and a wiper unit inserted and housed in a liquid storage portion of the container body so that the wiper unit can be turned, and having at least one wiper element which extends along the inner surface of the container body, and which can be turned in a circumferential direction along the curved inner surface, the wiper element being formed of a comparatively rigid base portion, and a wiper member fixed tom the base portion, formed of a soft synthetic resin or rubber adapted to elastically contact the inner surface of the container body during a turning movement of the wiper unit and capable of substantially completely wiping off a liquid deposited on the curved inner surface.

2. A container for liquids according to claim 1, wherein the container body is provided at an upper portion thereof with a cap capable of being put on and removed from the container body by turning, the wiper unit being adapted to be operated by at least one of cap-fitting and cap-removing turning movements.

3. A container for liquids according to claim 2, wherein the cap is inserted into the interior of the container body and provided with a member for taking out a predetermined quantity of the liquid.

4. A container for liquids according to claim 3, wherein the liquid take-out member is a cosmetics applicator.

5. A container for liquids according to claim 1, wherein the container body is of the type which does not have an opening besides an opening, a diameter of which is smaller than that of a trunk portion of the container body, provided at an upper portion thereof, the wiper unit being inserted in a compressed or folded state from the opening into the interior of the container body and rendered capable of contacting the curved inner surface of the container body when the wiper is spread out.

6. A container for liquids according to claim 5, wherein the wiper unit is formed as a unit by connecting plural wiper elements at lower or upper portions thereof to a wiper unit body by flexible members or hinges, the unit being thereby made foldable.

7. A container for liquids according to claim 5, wherein the wiper unit is formed as a unit by connecting plural wiper elements at lower or upper portions thereof to a wipe unit body via a spring member, the unit being thereby made compressible.

8. A container for liquids according to claim 1, wherein the wiper member of the wiper unit is engaged with the curved inner surface of the container body only when the curved inner surface is wiped therewith, and disengaged therefrom during the time other than the curved inner surface wiping time.

9. A container for liquids according to claim 1, wherein the liquid is a separated type liquid formed of not less than two kinds of liquids.

10. A container for liquids according to claim 1, wherein the liquid is cosmetics.

11. A container for liquids according to claim 1, wherein the additive element is a bubbly material, lame or microcapsules.

* * * * *